US009175461B2

(12) United States Patent
Bewley, Jr.

(10) Patent No.: US 9,175,461 B2
(45) Date of Patent: Nov. 3, 2015

(54) OFFSET GARBAGE DISPOSAL

(75) Inventor: Wilbur Carl Bewley, Jr., Nicholasville, KY (US)

(73) Assignee: General Electric Company, Schenectady, NY (US)

( * ) Notice: Subject to any disclaimer, the term of this patent is extended or adjusted under 35 U.S.C. 154(b) by 450 days.

(21) Appl. No.: 13/470,816

(22) Filed: May 14, 2012

(65) Prior Publication Data

US 2013/0299616 A1 Nov. 14, 2013

(51) Int. Cl.

*B02C 19/00* (2006.01)
*E03C 1/266* (2006.01)
*B02C 18/00* (2006.01)

(52) U.S. Cl.

CPC ..... *E03C 1/266* (2013.01); *B02C 18/0084* (2013.01); *B02C 18/0092* (2013.01)

(58) Field of Classification Search

CPC .. B02C 18/0092; B02C 18/062; B02C 18/06; B02C 18/18; B02C 18/0084; E03C 1/266
USPC ..... 241/46.013, 46.014, 46.016, 46.012
See application file for complete search history.

(56) References Cited

U.S. PATENT DOCUMENTS

| | | | | |
|---|---|---|---|---|
| 2,842,320 | A * | 7/1958 | Ewing | 241/46.013 |
| 2,902,225 | A * | 9/1959 | Hoaglund | 241/42 |
| 3,033,368 | A * | 5/1962 | Sherman | 209/155 |
| 3,112,079 | A * | 11/1963 | Niekamp et al. | 241/257.1 |
| 3,151,815 | A * | 10/1964 | Ohime | 241/46.013 |
| 3,163,371 | A * | 12/1964 | Hardy | 241/46.016 |
| 3,236,462 | A * | 2/1966 | Stout | 241/46.016 |
| 3,680,829 | A * | 8/1972 | McCoy | 241/46.013 |
| 3,801,998 | A * | 4/1974 | Macias | 4/629 |
| 5,123,600 | A * | 6/1992 | Takenaka | 241/46.013 |
| 5,779,165 | A * | 7/1998 | Kim | 241/33 |
| 6,007,006 | A * | 12/1999 | Engel et al. | 241/46.014 |
| 6,264,123 | B1 * | 7/2001 | Clark | 241/46.014 |
| 6,347,759 | B1 * | 2/2002 | Sedlak | 241/301 |
| 7,331,539 | B2 * | 2/2008 | Jara-Almonte et al. | 241/46.014 |
| 7,918,411 | B2 * | 4/2011 | Anderson et al. | 241/46.016 |
| 2008/0302890 | A1 | 12/2008 | Misawa et al. | |

FOREIGN PATENT DOCUMENTS

| | | |
|---|---|---|
| GB | 2 190 017 A | 11/1987 |
| JP | 2007203273 | 8/2007 |

* cited by examiner

*Primary Examiner* — Faye Francis

(74) *Attorney, Agent, or Firm* — Dority & Manning, P.A.

(57) ABSTRACT

A garbage disposal with an offset is provided. The garbage disposal includes a grinder mounted within a housing. The grinder rotates within the housing to process waste within the garbage disposal. Waste entering the housing is directed away from an axis of rotation of the grinder due to the offset. By directing waste away from the axis of rotation of the grinder, the waste can be more fully processed by the grinder.

16 Claims, 6 Drawing Sheets

OFFSET GARBAGE DISPOSAL

FIELD OF THE INVENTION

The present subject matter relates generally to garbage disposals, e.g., that may be mounted beneath kitchen sinks

BACKGROUND OF THE INVENTION

During cooking or cleaning within a kitchen, a sink can collect a significant amount of debris. For example, waste can collect within and around a drain of the sink during cleaning of dishes. Such waste can be large enough to clog the sink's drain if the waste is permitted to enter the drain. Accordingly, a user may be required to remove the waste from the sink. Conversely, certain kitchen sinks include a garbage disposal mounted beneath the sink to process such waste.

The garbage disposal is disposed in-line with sink's drain such that liquids and solid waste exiting the sink passes through the garbage disposal prior to entering the drain. The garbage disposal includes a mechanism for grinding solid waste passing through the garbage disposal. For example, a grinding ring can chop or mince solid waste within the garbage disposal into pieces small enough to pass through the sink's drain without clogging the drain.

Generally, the garbage disposal includes blades mounted to a plate that rotates about a center of rotation. During rotation of the plate, the plate and blades can urge waste towards the grinding ring. However, the garbage disposal's entrance is generally disposed directly above the center of rotation of the plate. Such a configuration can create problems during operation of the garbage disposal. For example, waste can collect on the plate at the center of rotation.

In particular, waste at the center of rotation may experience insufficient force to move the waste away from the plate's center of rotation. Such waste can accumulate on top of the plate at the center of rotation and not be urged onto the grinding ring by rotation of the plate. Further, such waste can remain disposed within the garbage disposal for extended periods of time and eventually create unpleasant odors or otherwise affect performance of the garbage disposal.

Accordingly, a garbage disposal with features for improved processing of waste would be useful. In particular, a garbage disposal with features for directing waste away from a center of rotation of the garbage disposal would be useful.

BRIEF DESCRIPTION OF THE INVENTION

The present subject matter provides a garbage disposal with an offset. The garbage disposal includes a grinder mounted within a housing. The grinder rotates within the housing to process waste within the garbage disposal. Waste entering the housing is directed away from an axis of rotation of the grinder due to the offset. By directing waste away from the axis of rotation of the grinder, the waste can be more fully processed by the grinder. Additional aspects and advantages of the invention will be set forth in part in the following description, or may be apparent from the description, or may be learned through practice of the invention.

In a first exemplary embodiment, a garbage disposal is provided that defines a radial direction and an axial direction. The garbage disposal includes a housing that defines a chamber and an entrance. The entrance of the housing has a central axis that extends along the axial direction. A grinder is disposed within the chamber of the housing. The grinder is configured for rotation about an axis of rotation that extends along the axial direction. A motor is in mechanical communication with the grinder such that the motor selectively rotates the grinder about the axis of rotation. The central axis of the entrance of the housing is offset from the axis of rotation of the grinder along the radial direction.

In a second exemplary embodiment, a garbage disposal is provided that defines an axial direction and a radial direction. The garbage disposal includes a housing that defines an entrance. The entrance of the housing has a central axis. The housing also comprises a chute for directing food articles from the entrance of the housing into a chamber defined by the housing. A grinder is disposed within the chamber of the housing. The grinder is configured for rotation about an axis of rotation. A motor is in mechanical communication with the grinder such that the motor selectively rotates the grinder about the axis of rotation. A projection is disposed within the chute of the housing. The projection has a surface that is sloped towards the central axis of the entrance of the housing. The surface of the projection is configured for directing food articles in the chute away from the axis of rotation of said grinder.

In a third exemplary embodiment, a garbage disposal is provided that defines a radial direction and an axial direction. The garbage disposal includes a housing that defines a chamber. A grinder is disposed within the chamber of the housing. The grinder is configured for rotation about an axis of rotation. A motor is in mechanical communication with the grinder such that the motor selectively rotates the grinder about the axis of rotation. The housing further defines an opening disposed above the grinder along the axial direction. The opening of the housing permits access to the chamber of the housing. The opening of the housing is offset from the axis of rotation of the grinder along the radial direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
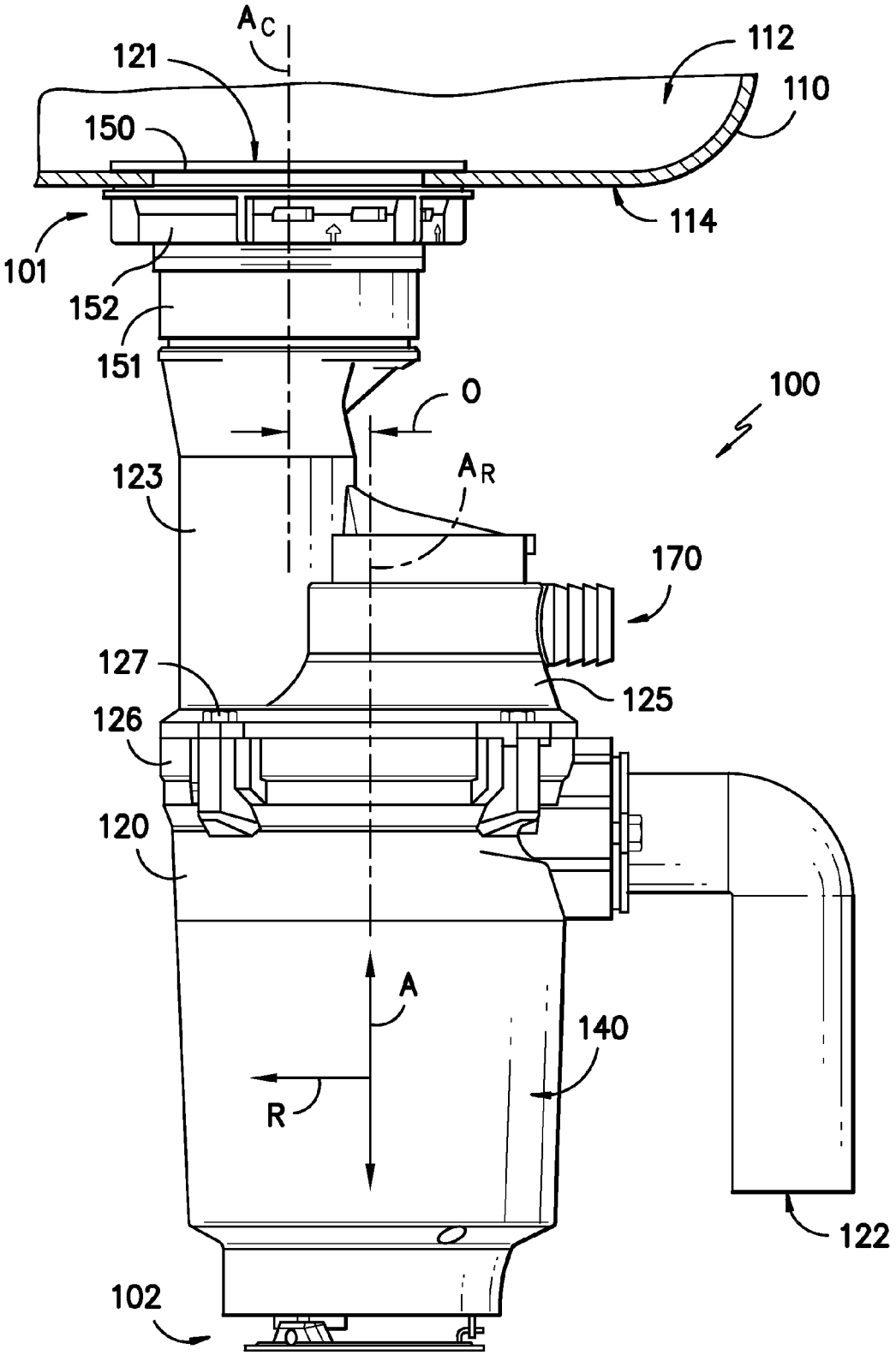
FIG. 1 provides a front view a garbage disposal according to an exemplary embodiment of the present subject matter mounted below a sink.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
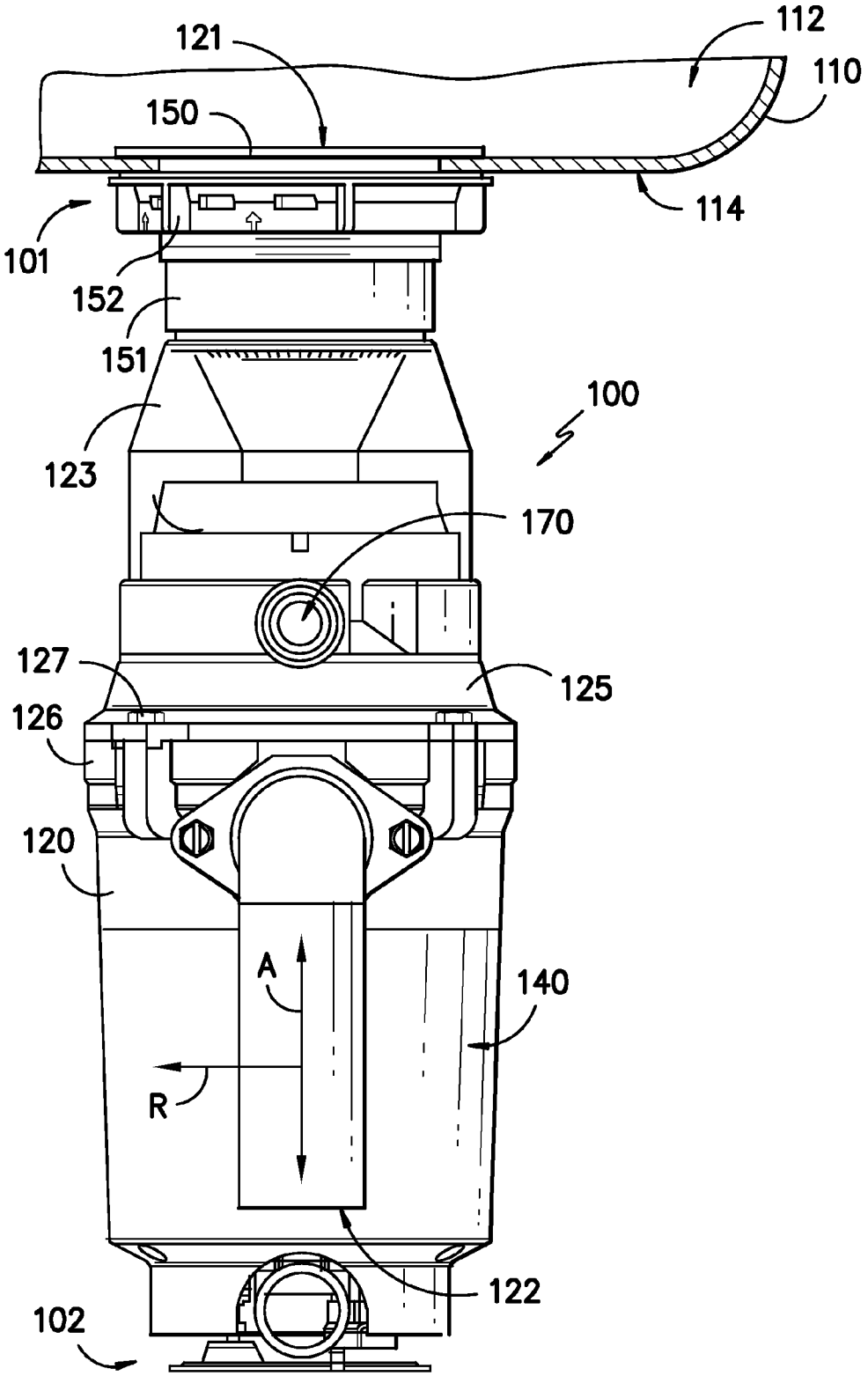
FIG. 2 is a side view of the garbage disposal of FIG. 1.
Figure 3:
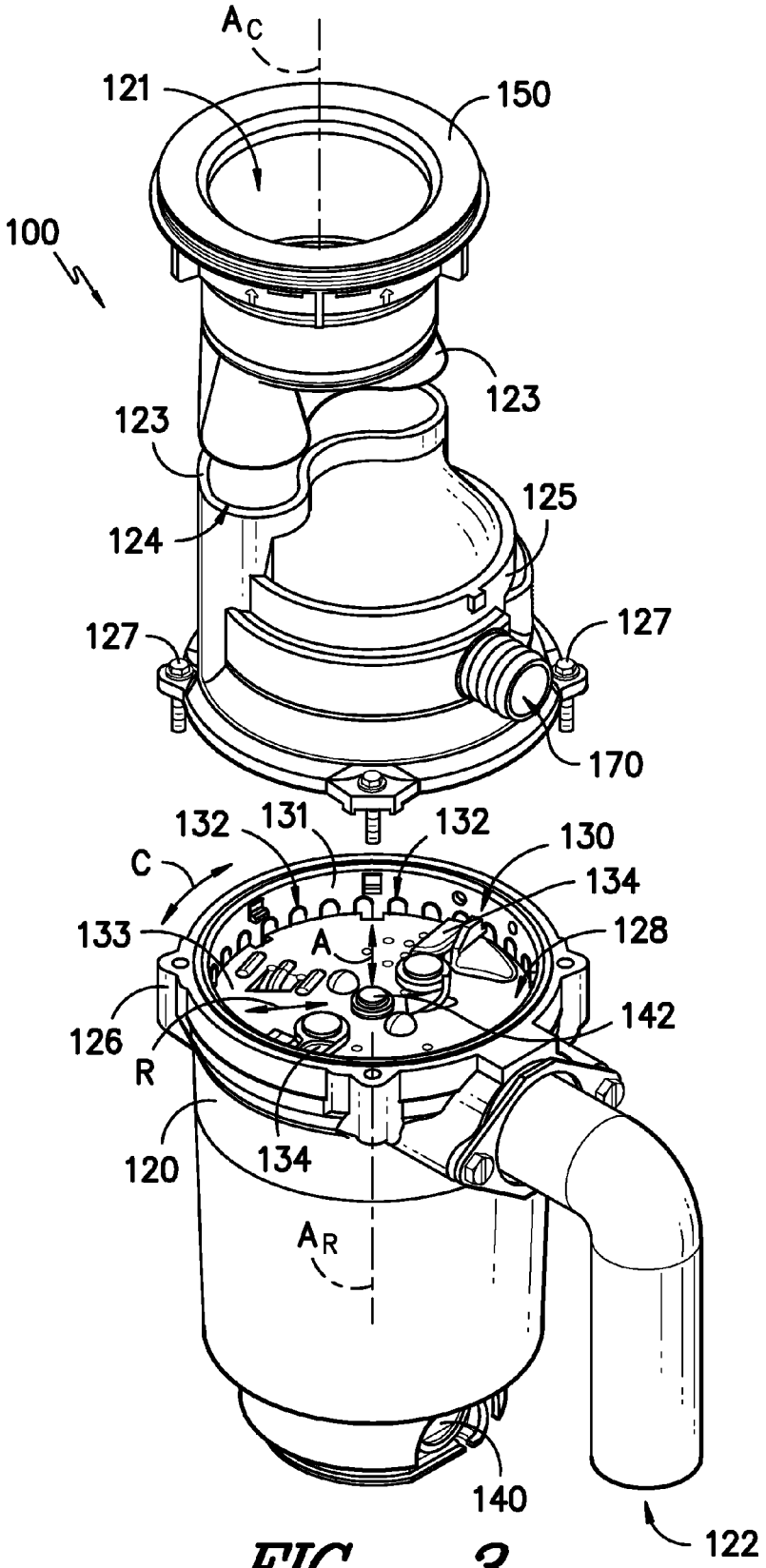
FIG. 3 illustrates an exploded view of the garbage disposal of FIG. 1.

FIG. 1 provides a front view a garbage disposal 100 according to an exemplary embodiment of the present subject matter as mounted below a sink 110. FIG. 2 is a side view of the garbage disposal 100. As may be seen in FIGS. 1 and 2, garbage disposal 100 extends between a top 101 and a bottom 102. Garbage disposal 100 also defines a radial direction shown by arrow R, an axial direction shown by arrow A that is parallel to an axis of rotation $A_R$ of a grinder 130 (shown in FIG. 3), and a circumferential direction shown by arrow C (FIG. 3). Axial direction A may be substantially vertical when garbage disposal 100 is mounted to sink 110 as shown in FIGS. 1 and 2.

Sink 110 defines a basin 112. Basin 112 of sink 110 is configured for containing, e.g., liquids such as water and detergent and utensils such as pots, pans, and dishes. As will be understood by those skilled in the art, during use of sink 110, basin 112 may collect solids that can potentially clog sink 110. For example, when cleaning dishes or processing food, large food particles can settle at a bottom 114 of sink 110. Such food particles can be processed by garbage disposal 100 in order to grind the food particles and hinder the same from clogging sink 110 as discussed in greater detail below.

Garbage disposal 100 is mounted to sink 110 with a flange 150 and a mounting ring 152 at top 101 of garbage disposal 100 as will be understood by those skilled in the art. In particular, flange 150 sits atop and extends through bottom 114 of sink 110. Mounting ring 152 is secured to flange 150. As an example, mounting ring 152 may be threaded to sleeve 151 of flange 150. In alternative exemplary embodiments, a spring clip may be secured to a sleeve 151 of flange 150, and mounting ring 152 may extend between bottom 114 of sink 110 and the spring clip. Other suitable mechanisms may be used to mount garbage disposal 100 to sink 110, e.g., glue or fasteners. A seal or gasket can also be provided to prevent leaking Garbage disposal 100 includes a housing 120 that extends between an entrance 121 and an exit 122. Thus, liquids and solids disposed within basin 112 can enter entrance 121 and pass through garbage disposal 100 to exit 122. From exit 122, such liquids and solids may enter a drain (not shown) that, e.g., is in fluid communication with a septic or sewer system (not shown). Entrance 121 has a central axis $A_C$ that extends along axial direction A through a center (e.g., a centroid) of entrance 121.

Garbage disposal 100 also includes an inlet 170 that can receive runoff from a dishwasher appliance (not shown). Thus, garbage disposal 100 can also process waste from the dishwasher appliance. Garbage disposal 100 need not include inlet 170. In addition, inlet 170 can be plugged when dishwasher appliance hookup is not desired or needed.

FIG. 3 illustrates an exploded view of garbage disposal 100. As may be seen in FIG. 3, housing 120 includes an upper housing 125 and a lower housing 126. Upper and lower housings 125 and 126 may be secured together using fasteners 127. In FIG. 3, a portion of upper housing 125 is shown in an exploded manner to reveal an opening 124 defined by a chute or passage 123 of upper housing 125. Chute 123 extends between entrance 121 and a chamber 128 of housing 120 defined between upper and lower housings 125 and 126. Food articles passing through chute 123 are funneled into opening 124. In turn, opening 124 guides such food articles into chamber 128 of housing 120 as discussed in greater detail below.

A grinder 130 is mounted within chamber 128. Grinder 130 is configured for processing waste within garbage disposal 100. Grinder 130 includes a plate or table 133 with a plurality of lugs or blades 134 rotatably mounted thereto. Plate 133 is rotatably mounted to a motor 140 with a shaft 142 that rotates about an axis of rotation $A_R$ that extends along axial direction A. For this exemplary embodiment, axis of rotation $A_R$ of plate 133 is substantially parallel to central axis $A_C$ of entrance 121. Motor 140 can be activated to rotate plate 133 via shaft 142 and, in turn, plurality of lugs 134 during operation of garbage disposal 100. Grinder 130 also includes a grinding ring 131 mounted to housing 120 and positioned adjacent plate 133 along the circumferential direction C. Grinding ring 131 defines a plurality of holes 132 disposed about the circumferential direction C.

As an example, during operation of garbage disposal 100, a user may urge waste items into entrance 121 of housing 120. Gravity urges such waste through chute 123 and into chamber 128. Within chamber 128, such waste may accumulate on plate 133 of grinder 130 as described in greater detail below. The user may activate garbage disposal 100 such that motor 140 rotates plate 133. Due to rotation of plate 133, the waste can be urged away from axis of rotation $A_R$ towards grinding ring 131. At grinding ring 131, the waste is forced through holes 132, e.g., by lugs 134. By forcing the waste through holes 132, the waste can be chopped or ground into pieces that are sized to pass through exit 122 with decreased potential for clogging exit 122.

As will be understood by those skilled in the art, during rotation of plate 133 described above, waste disposed on plate 133 at axis of rotation $A_R$ or 133 adjacent shaft 142 can experience forces insufficient to urge the waste towards grinding ring 131. Thus, waste can accumulate on plate 133 at axis of rotation $A_R$ or adjacent shaft 142. Garbage disposal 100 includes features for avoiding waste accumulation on plate 133.

As best seen in FIG. 1, the axis of rotation $A_R$ of plate 133 is offset or spaced apart from central axis $A_C$ of entrance 121 along radial direction R. In particular, the axis of rotation $A_R$ is spaced apart from central axis $A_C$ by an offset O along radial direction R. Offset O may be any suitable distance, e.g., half an inch, one inch, one and one half inch, or two inches.

Such a configuration of garbage disposal 100 helps to prevent waste accumulation on plate 133. For example, turning again to FIG. 3, as discussed above, waste from entrance 121 is urged by gravity through chute 123 (e.g., along central axis $A_C$) to chamber 128. Within chamber 128, such waste exits opening 124 and drops onto plate 133 at a position that is spaced apart along the radial direction R from axis of rotation $A_R$ because axis of rotation $A_R$ is offset from central axis $A_C$. Additional features of garbage disposal 100 that can assist in hindering waste accumulation on plate 133 are discussed in detail below.

Figure 4:
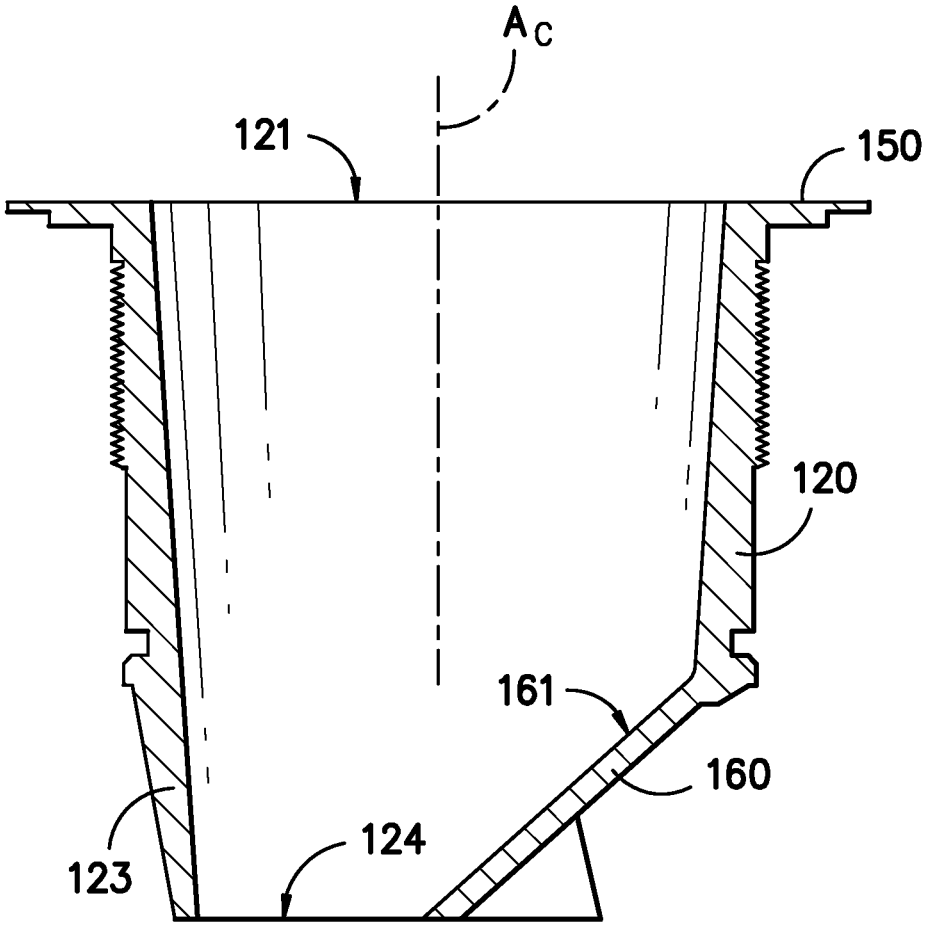
FIG. 4 illustrates a cross-sectional view of the chute of FIG. 3 taken along the 4-4 line of FIG. 5.
Figure 5:
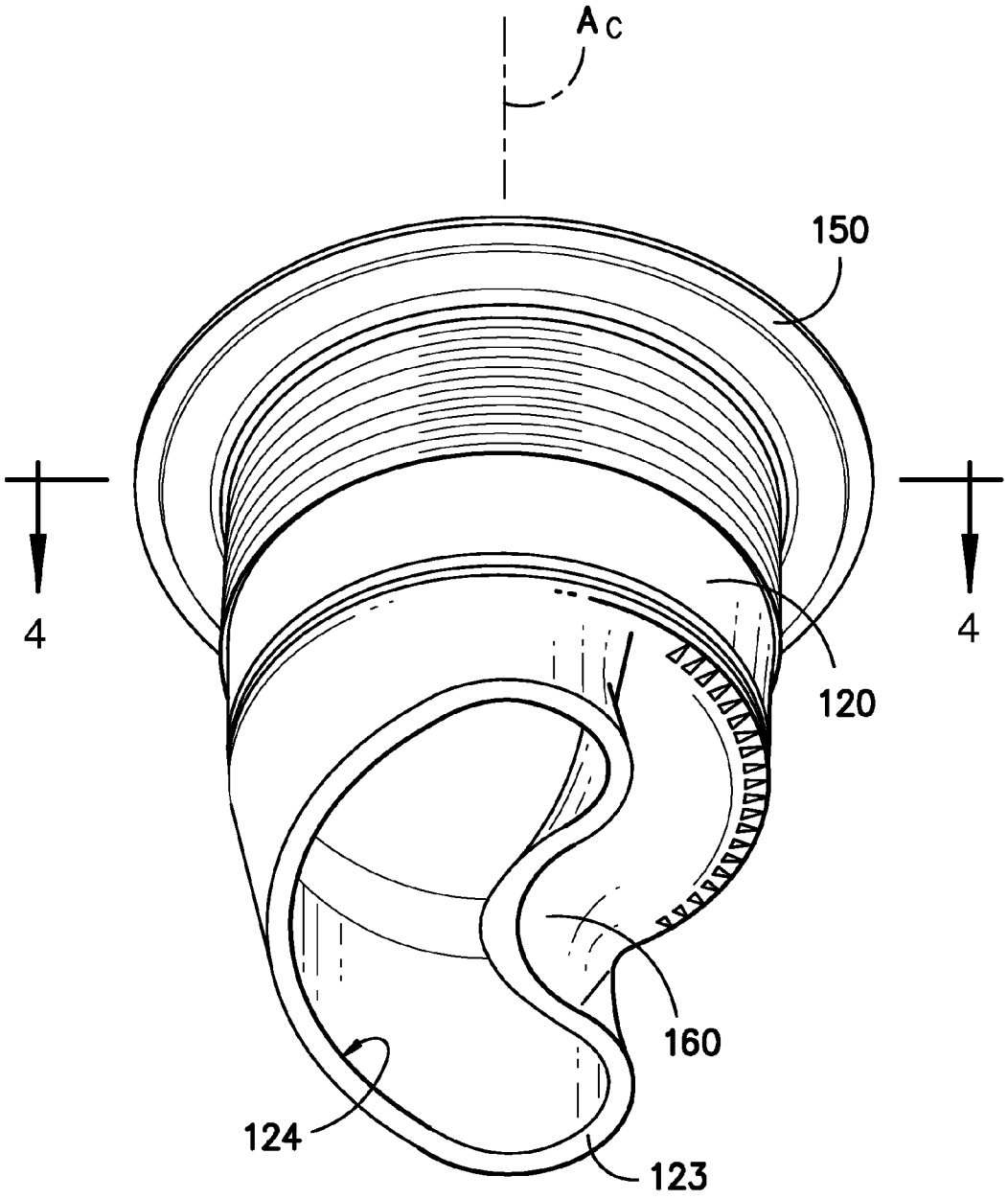
FIG. 5 is a bottom, perspective view of a chute of the garbage disposal of FIG. 3.

FIG. 4 illustrates a cross-sectional view of chute 123 taken along the 4-4 line of FIG. 5. FIG. 5 is a bottom, perspective view of chute 123 of housing 120. As discussed above, waste may enter housing 120 through entrance 121 (FIG. 4). Such waste may flow through chute 123 to opening 124. A projection 160 is disposed within and extends into chute 123. Projection 160 has a surface 161 (FIG. 4) that is sloped (e.g., downwardly when garbage disposal 100 is mounted to sink 210 as shown in FIG. 1) towards opening 124. Surface 161 is also sloped towards central axis $A_C$. As best seen in FIG. 4, waste flowing through chute 123 may impact projection 160 and slide along surface 161 of projection 160 to opening 124. Thus, projection 160 guides or directs waste within chute 123 to opening 124.

Figure 6:
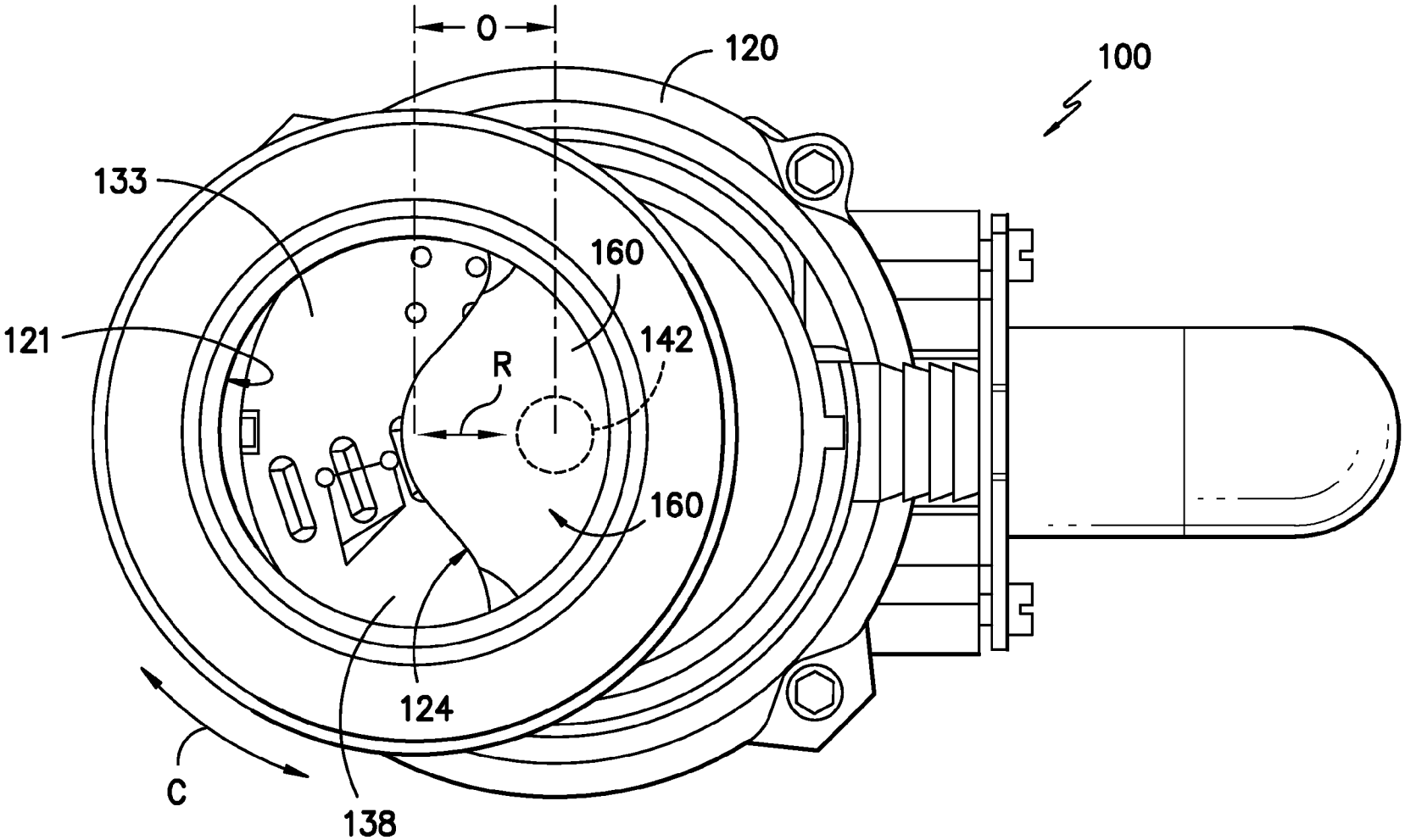
FIG. 6 provides a top view of the garbage disposal of FIG. 1.

FIG. 6 provides a top view of garbage disposal 100. As may be seen in FIG. 6, projection 160 is positioned over shaft 142 along the axial direction A (FIG. 3). As discussed above, shaft 142 rotates about axis of rotation $A_R$ (FIG. 3). Thus, axis of rotation $A_R$ of plate 133 extends though projection 160. Further, as discussed above, waste flowing through chute 123 may impact projection 160 and slide along surface 161 of projection to opening 124. Because projection 160 is positioned over shaft 142, projection 160 hinders such waste from accumulating on plate 133 at the axis of rotation $A_R$ or adjacent shaft 142 by directing such waste to opening 124 that is offset from axis of rotation $A_R$.

Accordingly, opening 124 is positioned away from axis of rotation $A_R$, e.g., along the radial direction R. By positioning opening 124 offset from axis of rotation $A_R$, e.g., along the radial direction R, waste entering chamber 128 through opening 124 is directed away from axis of rotation $A_R$ and shaft 142. Thus, such waste is hindered from collecting on plate 133 at axis of rotation $A_R$ or adjacent shaft 142. In particular, rotation of plate 133 can provide sufficient force to the waste to urge the waste towards grinding ring 131 (FIG. 3) because such waste is deposited on an outer portion 138 (e.g., a radially outermost portion) of plate 133 by opening 124.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A garbage disposal, the garbage disposal defining a radial direction and an axial direction, the garbage disposal comprising:

a housing defining a chamber and a chute that extends between a circular entrance and an arcuate opening, the circular entrance of said housing having a central axis that extends along the axial direction, the chute configured for directing food articles from the circular entrance of said housing into the chamber of said housing though the arcuate opening of said housing;

a grinder disposed within the chamber of said housing, said grinder configured for rotation about an axis of rotation that extends along the axial direction, said grinder having a plate and a plurality of lugs mounted to said plate;

a grinding ring mounted to housing, said grinding ring extending about the plate of said grinder, said grinding ring defining a plurality of holes positioned adjacent the plate of said grinder; and a motor in mechanical communication with said grinder such that said motor selectively rotates said grinder about the axis of rotation;

wherein, the central axis of the circular entrance of said housing is offset from the axis of rotation of said grinder along the radial direction, the arcuate opening of said housing also offset from the axis of rotation of said grinder along the radial direction, the arcuate opening of said housing positioned between the circular entrance of said housing and the chamber of said housing along the axial direction, the arcuate opening of said housing also positioned directly over the plate of said grinder along the axial direction.

2. The garbage disposal of claim 1, further comprising a projection, wherein said projection is disposed within the chute of said housing, said projection having a surface that is sloped towards the central axis of the circular entrance of said housing, the surface of said projection configured for directing food articles within said chute away from the axis of rotation of said grinder.

3. The garbage disposal of claim 1, wherein said motor is mounted within said housing below said grinder along the axial direction.

4. The garbage disposal of claim 1, wherein the axis of rotation of said grinder is substantially vertically oriented when the garbage disposal is mounted to a sink.

5. The garbage disposal of claim 1, wherein said housing further comprises an inlet for directing fluid from a dishwasher appliance into the chamber of said housing.

6. The garbage disposal of claim 1, wherein said chute is positioned and oriented such that said chute directs waste to a radially outermost portion of said grinder.

7. A garbage disposal, the garbage disposal defining an axial direction and a radial direction, the garbage disposal comprising:

a housing defining an entrance and an arcuate opening, the entrance of said housing having a central axis, said housing also comprising a chute for directing food articles from the entrance of said housing into a chamber defined by said housing via the arcuate opening of said housing, the arcuate opening of said housing positioned such that the arcuate opening of said housing is contiguous with the chamber of said housing;

a grinder disposed within the chamber of said housing, said grinder configured for rotation about an axis of rotation, the central axis of the entrance of said housing being offset from the axis of rotation of said grinder along the radial direction, the arcuate opening of said housing also offset from the axis of rotation of said grinder along the radial direction, said grinder having a plate and a plurality of lugs mounted to said plate, the arcuate opening of said housing also positioned directly over the plate of said grinder along the axial direction;

a grinding ring mounted to housing, said grinding ring extending about the plate of said grinder, said grinding ring defining a plurality of holes positioned adjacent the plate of said grinder;

a motor in mechanical communication with said grinder such that said motor selectively rotates said grinder about the axis of rotation; and a projection disposed within the chute of said housing, said projection having a surface that is sloped towards the central axis of the entrance of said housing, the surface of said projection configured for directing food articles in said chute away from the axis of rotation of said grinder.

8. The garbage disposal of claim 7, wherein said motor is mounted within said housing below said grinder along the axial direction.

9. The garbage disposal of claim 7, wherein said grinder is configured for rotation about a substantially vertical axis.

10. The garbage disposal of claim 7, wherein said housing further comprises an inlet for directing fluid from a dishwasher appliance into the chamber of said housing.

11. A garbage disposal, the garbage disposal defining a radial direction and an axial direction, the garbage disposal comprising:

a housing defining a chamber;

a grinder disposed within the chamber of said housing, said grinder configured for rotation about an axis of rotation, said grinder having a plate and a plurality of lugs mounted to said plate;

a grinding ring mounted to housing, said grinding ring extending about the plate of said grinder, said grinding ring defining a plurality of holes positioned adjacent the plate of said grinder; and a motor in mechanical communication with said grinder such that said motor selectively rotates said grinder about the axis of rotation;

wherein, said housing further defines a circular entrance and an arcuate opening, the arcuate opening positioned between the circular entrance of said housing and the chamber of said housing, the arcuate opening also disposed directly over at least one lug of the plurality of lugs of said grinder along the axial direction, the arcuate opening of said housing permitting access to the chamber of said housing, the arcuate opening of said housing offset from the axis of rotation of said grinder along the radial direction.

12. The garbage disposal of claim 11, further comprising a projection, wherein said housing comprises a chute for directing food articles from an entrance of said housing into the chamber of said housing, wherein said projection is disposed within the chute of said housing, said projection having a surface that is sloped towards the arcuate opening of said housing, the surface of said projection configured for directing food articles within said chute away from the axis of rotation of said grinder.

13. The garbage disposal of claim 11, wherein said motor is mounted within said housing below said grinder along the axial direction.

14. The garbage disposal of claim 11, wherein said grinder is configured for rotation about a substantially vertical axis.

15. The garbage disposal of claim 11, wherein said housing further comprises an inlet for directing fluid from a dishwasher appliance into the chamber of said housing.

16. The garbage disposal of claim 11, wherein the arcuate opening of said housing is positioned and oriented such that the arcuate opening of said housing directs waste to a radially outermost portion of said grinder.

* * * * *